United States Patent [19]

Arthur et al.

[11] Patent Number: 4,949,812

[45] Date of Patent: Aug. 21, 1990

[54] DESCENT SYSTEM

[75] Inventors: Ronald W. Arthur; Huwald, Edmund, both of Victoria, Australia

[73] Assignee: Ullapara Holdings Pty. Ltd., New South Wales, Australia

[21] Appl. No.: 348,640

[22] PCT Filed: Jun. 28, 1988

[86] PCT No.: PCT/AU88/00218

§ 371 Date: Apr. 5, 1989

§ 102(e) Date: Apr. 5, 1989

[87] PCT Pub. No.: WO89/00063

PCT Pub. Date: Jan. 12, 1989

[30] Foreign Application Priority Data

Jun. 29, 1987 [AU] Australia ..... PI2773

[51] Int. Cl.[5] ..... A62B 1/14; B66D 5/16

[52] U.S. Cl. ..... 182/234; 182/239; 188/65.4

[58] Field of Search ..... 182/5, 6, 7, 233, 234, 182/238, 239, 192; 188/65.4, 65.5

[56] References Cited

U.S. PATENT DOCUMENTS

| | | | |
|---|---|---|---|
| 198,649 | 12/1877 | McKee | 182/192 |
| 300,857 | 6/1884 | Evans | 188/65.4 |
| 3,880,255 | 4/1975 | Huntley | 182/5 |
| 4,024,927 | 5/1977 | Sheppard | 182/5 |
| 4,301,892 | 11/1981 | Arce | 182/233 |
| 4,567,962 | 2/1986 | Kladitis | 182/5 |
| 4,602,699 | 7/1986 | Matt | 182/234 |

*Primary Examiner*—Reinaldo P. Machado
*Attorney, Agent, or Firm*—Finnegan, Henderson, Farabow, Garrett & Dunner

[57] ABSTRACT

A lowering device for assisting persons to escape from multi-storied buildings in an emergency situation, and adapted to engage a cable or rope of twisted configuration. The device includes an inner rotatable sleeve surrounding and engaging the cable to follow the twist therein and rotate about the cable as it descends down the cable. The inner sleeve is contained within an outer housing which, in turn, supports a person, and the speed of rotation of the inner sleeve and thus the rate of descent of the device down the cable is controlled by a centrifugal brake having bell cranks carried by the inner sleeve and each pivotal against tension springs under centrifugal force to cause eccentrics on the ends of the cranks to act on brake shoes which engage a brake surface on part of the outer housing.

10 Claims, 8 Drawing Sheets

DESCENT SYSTEM

TECHNICAL FIELD

This invention relates to a device and a system to enable persons to descend from elevated locations, such as; from high rise building in emergency situations; from cliff faces in rescue operations; or for use by defence personnel when descending from helicopters; although the system is applicable to any situation where a person, or for that matter other loads, is to descent at a controlled rate from an elevation location.

BACKGROUND ART

The essence of the system of the present invention rests with descent down a cable or rope, and although descent systems utilizing cables or ropes are known, such require some degree of training and experience in controlling the rate of descent, and thus are not suitable for escape or rescue operations when, not only are the persons involved inexperienced, but are also in a severely stressful situation, involving a degree of panic and fear generated by the danger to which they are subjected, in the case, for example of the fire in a high rise building, coupled with the necessity to escape from a particularly high location which in itself presents its own fears. In addition, in cases where the persons concerned are injured or even unconscious or semi-conscious, and therefore not in a position to control the rate of descent, then they are totally reliant on the system to lower them to the ground and also control their rate of descent.

Other systems which have been proposed include the use of flexible chutes, but such systems have their limitations with regard to the height over which they can operate and other difficulties particularly with escape from high rise buildings where fires at lower levels within the building, not only involve the existence of flames, but also the creation of unstable conditions adjacent the faces of the building as a result of updrafts of hot air.

DISCLOSURE OF THE INVENTION

It is therefore an object of the present invention to provide a lowering device and a descent system which in itself can control the rate of descent of a person or other load, and which is not unduly effected by the conditions in which it may be required to operate.

The invention therefore envisages a lowering device adapted in use to engage a cable or rope of a twisted configuration, and comprising an inner rotatable means surrounding and engaging said cable or rope to follow the twist therein and thereby rotate about the cable or rope as it descends down said cable or rope, said rotatable means being supported by, and rotatably within, an outer housing having means to support a load therefrom, and means for controlling the speed of rotation of said rotatable means and therefore the rate of descent of said lowering device down said cable or rope.

With such a lowering device, although the inner rotatable means is free to rotate about the cable or rope as it descends, the weight of the person hanging on the outer housing holds the outer housing against uncontrolled rotation about the cable or rope and thus the persons being lowered maintains a fixed position relative to, and supported by, the cable or rope as they descend.

The invention also envisages a system for descending for elevated locations, including a lowering device as defined above, and a cable or rope adapted to extend from the elevated location to an anchor point at ground level.

Preferably the means for controlling the speed of rotation of the inner rotatable means is a closed circuit gear pump driven by the inner means and forming part of a hydraulic circuit containing a constriction to control the speed of the pump and therefor the speed of rotation of the inner means and therefor the speed of descent.

Alternatively the means for controlling the speed of rotation of the inner rotatable means may be a centrifugal brake rotating with the inner means and engaging the outer housing with a force which increases and decreases with increasing and decreasing speed of rotation to maintain a relatively constant speed of rotation and therefore speed of descent.

Preferably said system includes means to support a persons carried by said lowering device and in the form of a support bar detachably connected to the outer housing and to which the person is strapped.

Preferably said support bar is attached at its upper end to said housing and at its lower end to a guide sleeve adapted to surround said cable or rope, and carries means at its lower end to engage beneath the buttocks of the person, together with handle means extending away from said support bar approximately mid way along its length and to be grasped by the person, with strap means also carried by said support bar to be received and fastened about the body of the person.

Preferably said cable or rope is stored on a pulley system located at the elevated location from which it is unwound and lowered to ground level for attachment to an anchor point, and said pulley system incorporates means to progressively transfer a plurality of said lowering devices in turn along said cable or rope to a loading station at which said support means, and associated persons, are, in turn, coupled to said lowering devices to descend down said cable or rope.

Preferably said loading station is situated at the end of a platform means adapted to extend beyond said elevated location.

BRIEF DESCRIPTION OF THE DRAWINGS

A number of preferred embodiments of the invention will now be described with reference to the accompanying drawings, in which.

BEST MODE FOR CARRYING OUT THE INVENTION

Figure 1:
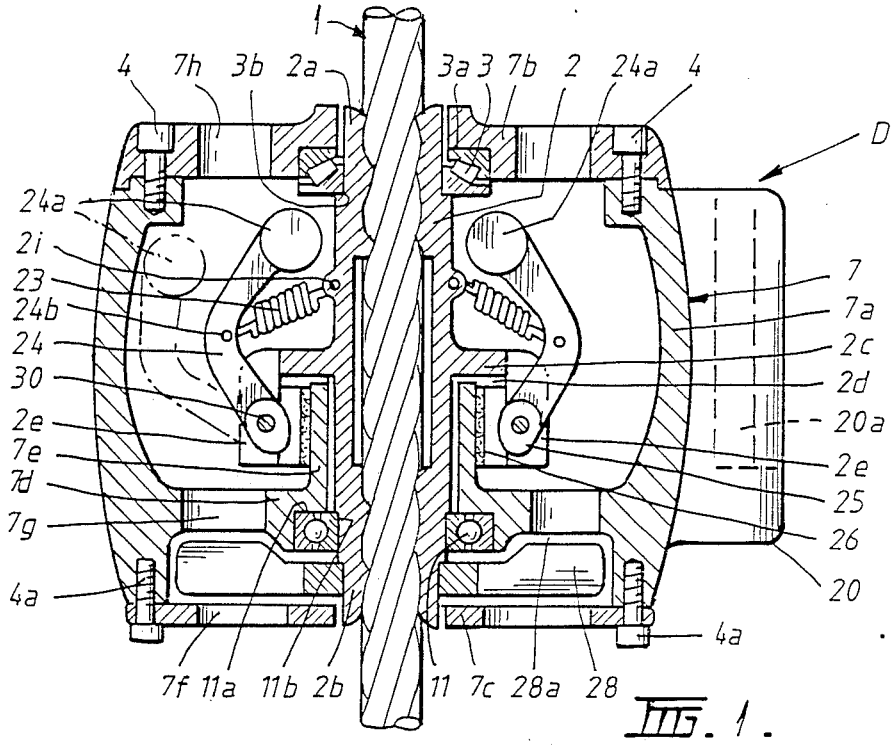
FIG. 1 is a vertical sectional view of a lowering device in accordance with a first embodiment of the invention and co-operating with a cable or rope.
Figure 2:
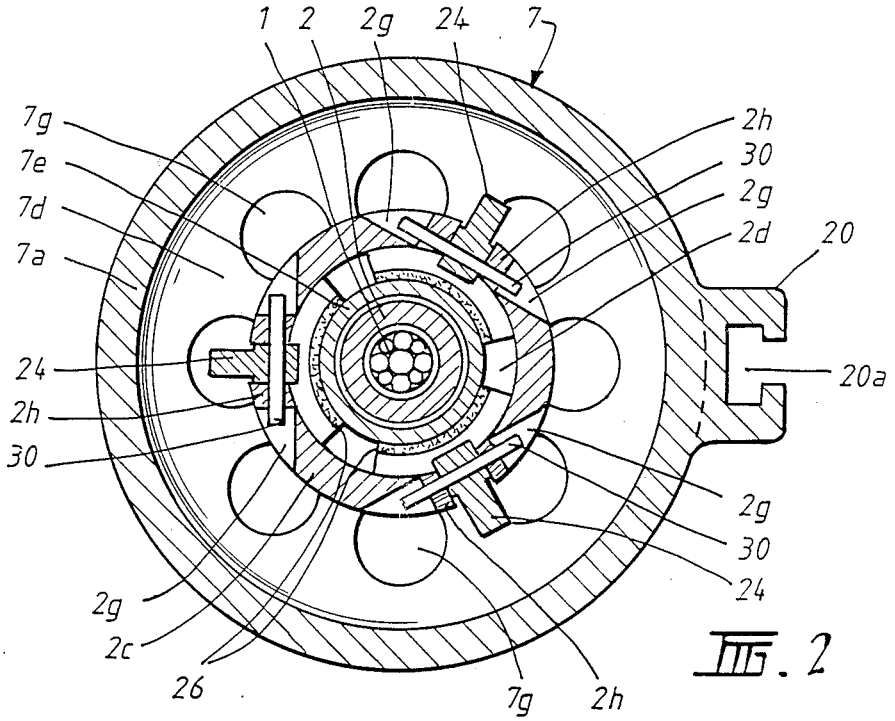
FIG. 2 is a transverse cross-sectional view of the lowering device of FIG. 1.

Turning firstly to FIGS. 1 and 2 of the drawings, the lowering device D in accordance with the first preferred embodiment of the invention comprises an inner rotatable tubular member forming a sleeve 2 surrounding a cable 1 down which the lowering device is to travel. The cable 1 is formed from a plurality of spirally wound or twisted cable strands (see FIG. 16) and is of an A1 non-rotatable non-unwinding type. The upper and lower end portions 2*a* and 2*b* of the sleeve 2 have helical profiles formed therein to match and engage the spiral or twisted profile of the cable, whereby, when the sleeve runs down along the length of the cable, it will rotate about the cable as it follows the spiral or twisted path of the cable strands.

A bell shaped housing 2*c* is formed as part of, and surrounds, the sleeve 2, and such as to define the downwardly directed annular cavity 2*d* between itself and the sleeve. A plurality, in this case three, apertures 2*e* are provided through the wall of the housing 2*c* at equally spaced positions around the circumference of the housing. Each aperture 2*e* receives and pivotally supports a lower end of a bell crank lever 24 at a pivot pin 30. Cutouts 2*g* are provided at either side of the apertures 2*e* to in effect form lugs 2*h* on either side of the aperture through which the pivot pins 30 are received. The free end of each bell crank lever is weighted at 24*a*, and is biased toward the sleeve 2 by means of a tension spring 23 coupled between the bell crank lever at a point 24*b* mid way along its length and to a connecting lug 2*i* on the sleeve 2.

The sleeve 2 is surrounded by a main housing 7 consisting of a generally cylindrical outer wall 7*a*, an upper end wall 7*b* and a lower end wall 7*c*, bolted at 4 and 4*a* respectively to the ends of the outer wall 7*a*. The upper end wall 7*b* surrounds the upper end portion 2*a* of the sleeve 2 and a thrust bearing 3 is received and retained between an undercut 3*a* in the end wall 7*b* and a ledge 3*b* around the sleeve 2. The outer wall 7*a* of the main housing has a radially inwardly directed flange 7*d* and a ledge 11*b* around the sleeve 2. The inner edge of the flange 7*d* is formed with an upwardly directed cylindrical brake member 7*e* which extends around and adjacent the sleeve 2 within the annular cavity 2*d*. The pivoted ends of each bell crank lever 24 have eccentrics 25 formed thereon which, in turn, bears against a brake shoe 26 and such that, as the bell crank levers 24 pivot about their pivot pins 30, the eccentrics will progressively force the associated brake shoe 26 into increasingly harder engagement with the radially outwardly facing surface of the brake member 7*e*.

A fan blade 28 is attached around the lower end of the sleeve 2 to rotate therewith, and is located in a chamber 28*a* formed between the lower end wall 7cand the flange 7*d* of the outer wall 7*a*. The fan serves to draw cooling through apertures 7*f* in the end wall 7cand directed upwardly through apertures 7*g* in the flange 7*d*, through the arrangement of the braking member 7*e* and the brake shoes 26, and then out through apertures 7*h* in the upper end wall 7*b*.

The lowering device is completed by a connection lug 20 formed on the outside surface of the outer wall 7*a* and having a T-shaped slot or keyway 20*a* formed vertically downwardly therethrough from an opening at the top of the lug 20 but terminating short of the lower end of the lug, and in which is engaged an appropriately shaped latching member forming part of a support frame for a person, which support frame will be described later.

In use, the weight of a person suspended from the lowering device in a manner to be later described, causes the lowering device to move down the cable 1 by virtue of the inner sleeve 2 following the spiral or twisted part of the inner sleeve 2 following the spiral or twisted part of the cable strand sand such as to in effect cause the sleeve to rotate about the cable as it moves down the cable. As the rate of descent increases so does the speed of rotation of the sleeve 2 around the cable and the bell crank levers 24 rotating with the sleeve pivot outwardly about their pivot pins 30 under the influence of the centrifugal forces generated and against the biasing action of the springs 23. The greater the speed of rotation the greater the degree of pivoting of the bell crank levers and the effect of the eccentric formations 25 on the pivoted ends of the bell crank lever, and their engagement with the brake shoes 26, is such as to force the brake shoes into progressively harder engagement with the cylindrical brake member 7*e*. The faster the speed of rotation of the sleeve and bell crank levers, the greater the centrifugal force, the greater the degree of pivoting of he bell crank levers and the greater the brake pressure, all resulting in the speed of rotation being slowed and the bell crank levers 24 tending to pivot inwardly under the action of the biasing springs 23 to reduce the braking pressure. It will be appreciated that, largely dependent on the weight of the person suspended from the lowering device, and the diameter and twist pitch of the cable, the braking system will adopt a set braking force and therefore substantially constant speed of rotation of the sleeve 2, and thus rate of descent down the cable 1, all of which can be calculated to achieve a satisfactory rate of descent consistent with a safe rate when the person contacts ground level.

Figure 3:
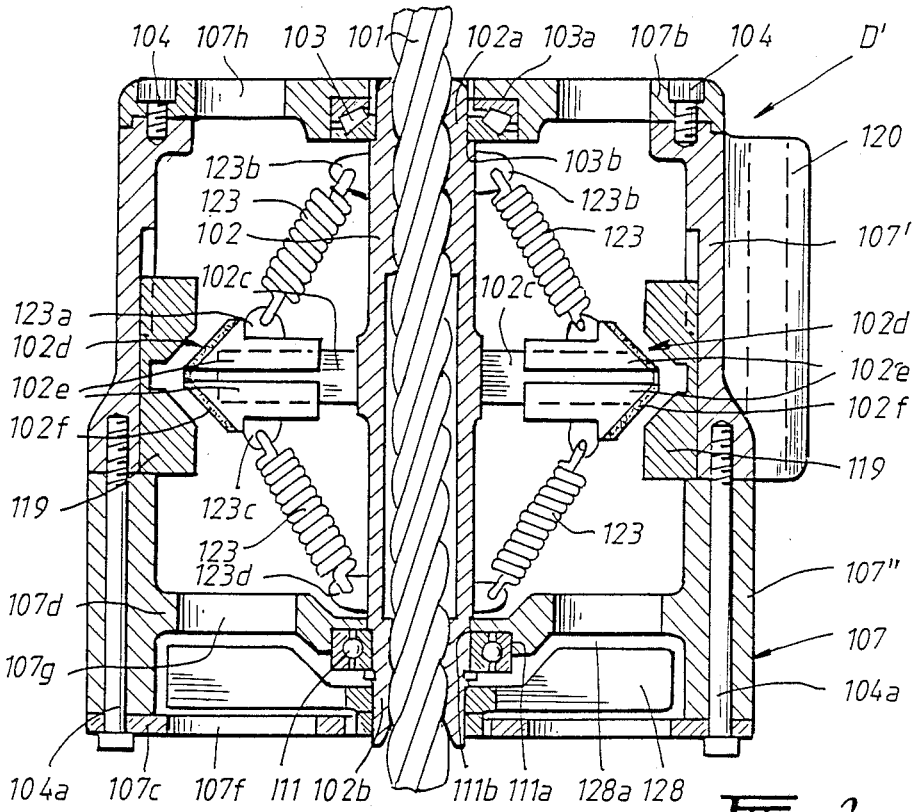
FIG. 3 is a vertical sectional view of a lowering device in accordance with the second embodiment of the invention and also co-operating with the cable or rope.
Figure 4:
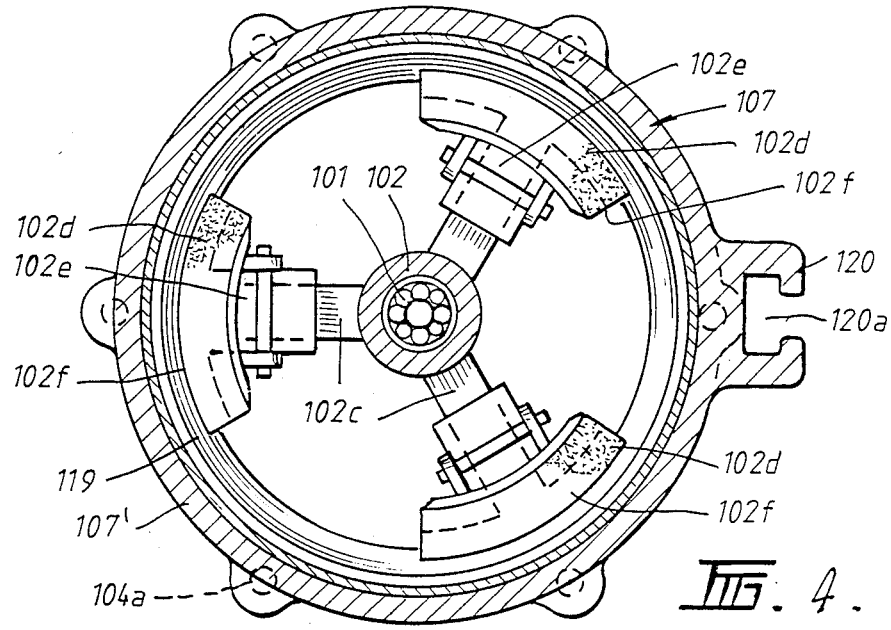
FIG. 4 is a transverse cross-sectional view of the lowering device of FIG. 3.

Turning to FIGS. 3 and 4 of the drawings, the lowering device D' in accordance with the second preferred embodiment of the invention once again comprises an inner rotatable tubular member forming a sleeve 102 surrounding a cable 101 down which the lowering device is to travel. As with the embodiment of FIGS. 1 and 2, the cable 101 is formed from a plurality of spirally wound or twisted cable strands (see FIG. 16) and is of an A1 non-rotatable non-unwinding type. The upper and lower end portions 102*a* and 102*b* of the sleeve 102 have helical profiles formed therein to match and engage the spiral or twisted profile of the cable, whereby, when the sleeve runs down along the length of the cable it will rotate about the cable as it follows the spiral or twisted path of the cable strands.

The sleeve 102 carries a plurality, in this case three, brake shoe support members 102*c* extending radially away therefrom at equally spaced positions around the sleeve 102, and upon each which a brake shoe arrangements 102*d* is positioned to slide therealong and radially with respect to the sleeve. Each brake shoe arrangement comprises a pair of segments 102*e* surrounding diametrically opposed sides of the support members 102*c*, and carry at their outer ends a layer 102*f* of brake friction material. The radially outer ends of the segments are angled as shown so that the combination of segments presents a V-shaped brake surface extending circumferentially as part of an arc of a circle as shown in FIG. 4. Each segment 102*e* is in turn connected to the sleeve via a tension spring 123, one of the segments being connected to the upper end portion 102*a* of the sleeve via connecting lugs 123*a* and 123*b* for the spring on the segment and sleeve respectively, and the other of the segments being connected to the lower end portion 102*b* via connecting lugs 123*c* and 123*d* for the spring on the segment and sleeve respectively.

The sleeve 102 is surrounded by a main housing 107 consisting of two axially aligned cylindrical outer walls 107' and 107'', an upper end wall 107*b* and a lower end wall 107*c*. End wall 107*b* is bolted at 104 to the end of the outer wall 107' whilst lower end wall 107*c*is bolted at 104*a* to the end of the outer wall 107'', which bolts also extend through the length of wall 107'' to engage the other outer wall 107' to connect the outer walls together. The upper end wall 107*b* surrounds the upper end portion 102*a* of the sleeve 102 and a thrust bearing 103 is received and retained between an undercut 103*a* in the end wall 107*b* and a ledge 103*b* around the sleeve 102. The outer wall 107'' of the main housing has a radially inwardly directed flange 107*d* formed as part thereof which terminates adjacent and around the lower end portion 102*b* of the sleeve and a ball bearing 111 is received and retained between an undercut 111*a* in the flange 107*d* and a ledge 111*b* around the sleeve 102.

A fan blade 128 is attached around the lower end of the sleeve 102 to rotate therewith, and is located in a chamber 128*a* formed between the lower end wall 107*c*and the flange 107*d* of the outer wall 107''. The fan services to draw cooling through apertures 107*f* in the end wall 107*c*and direct it upwardly through apertures 107*g* in the flange 107*d*, through the arrangement of the brake shoes 102*d* and the brake ring 119, and then out through apertures 107*h* in the upper end wall 107*b*.

The lowering device of the embodiment of FIGS. 3 and 4 is also completed by a connection lug 120 formed on the outside surface of the outer wall 107' and having a T-shaped slot or keyway 120*a* formed vertically downwardly therethrough from an opening at the top of the lug 120, but terminating short of the lower end of the lug, and in which is engaged the appropriately shaped latching member forming part of the support frame for a person, and as will be described later.

In use, the weight of a person suspended from the lowering device in a manner to be later described, causes the lowering device to move down the cable 101 by virtue of the inner sleeve 102 following the spiral or twisted part of the cable strands and such as to in effect cause the sleeve to rotate about the cable as it moves down the cable. As the rate of descent increases so does the speed of rotation of the sleeve 102 around the cable and the brake shoe arrangements 102*d* rotating with the sleeve slide radially outwardly on their associated support members 102*c* under the influence of the centrifugal forces generated and against the biasing action of the springs 123. The greater the speed of rotation the greater the degree of radial movement of the brake shoe arrangements and such as to progressively force the brake shoes into progressively harder engagement with the brake ring 119. The faster the speed of rotation of the sleeve, the greater the centrifugal force, the greater the degree of movement of the brake shoe arrangements and the greater the brake pressure, all resulting in the speed of rotation being slowed and the brake shoe arrangements tending to move radially inwardly under the action of the biasing springs 23 to reduce the braking pressure. Once again, it will be appreciated that, largely dependent on the weight of the person suspended from the lowering device, and the diameter and twist pitch of the cable, the braking system will adopt a set braking force and therefore substantially constant speed of rotation of the sleeve 2, and thus rate of descent down the cable 101, all of which can be calculated to achieve a satisfactory rate of descent consistent with a safe rate when the person contacts ground level.

Figure 5:
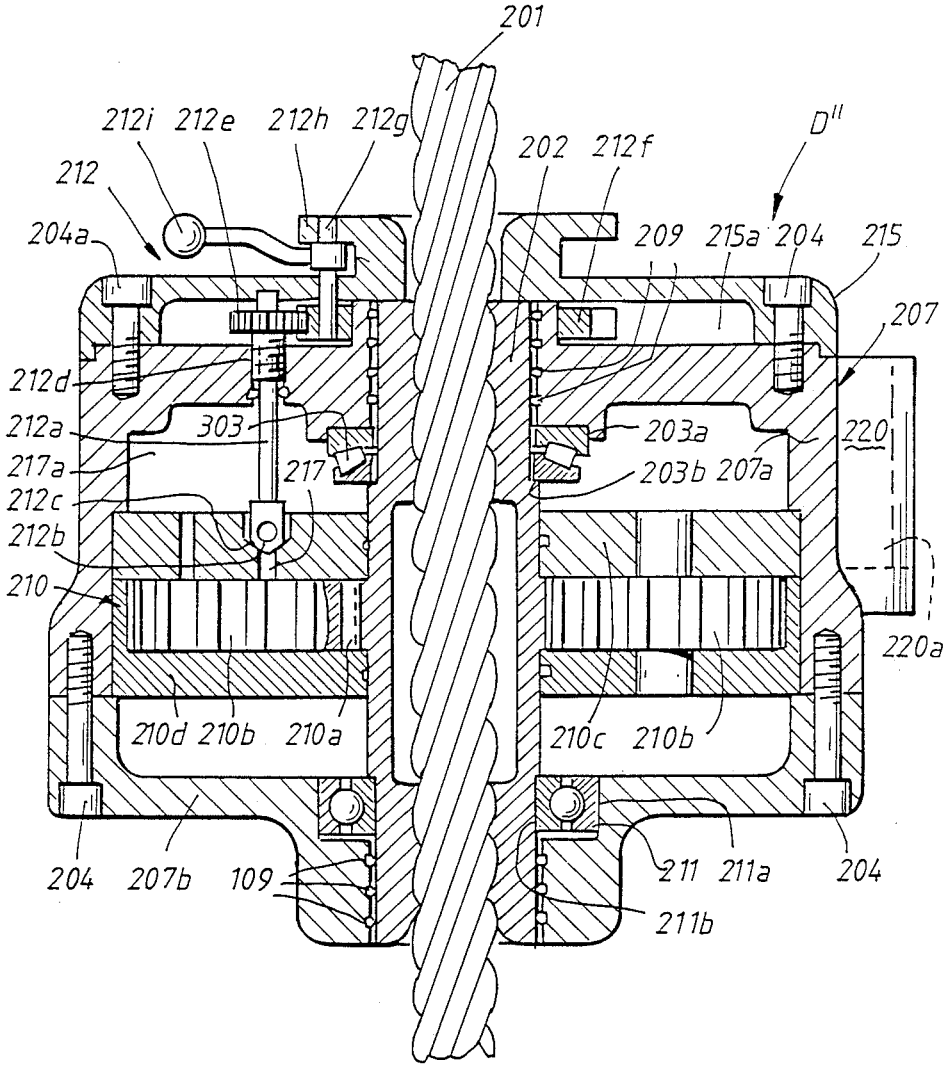
FIG. 5 is a vertical sectional view of a lowering device in accordance with a third embodiment of the invention and also co-operating with a cable or rope.
Figure 6:
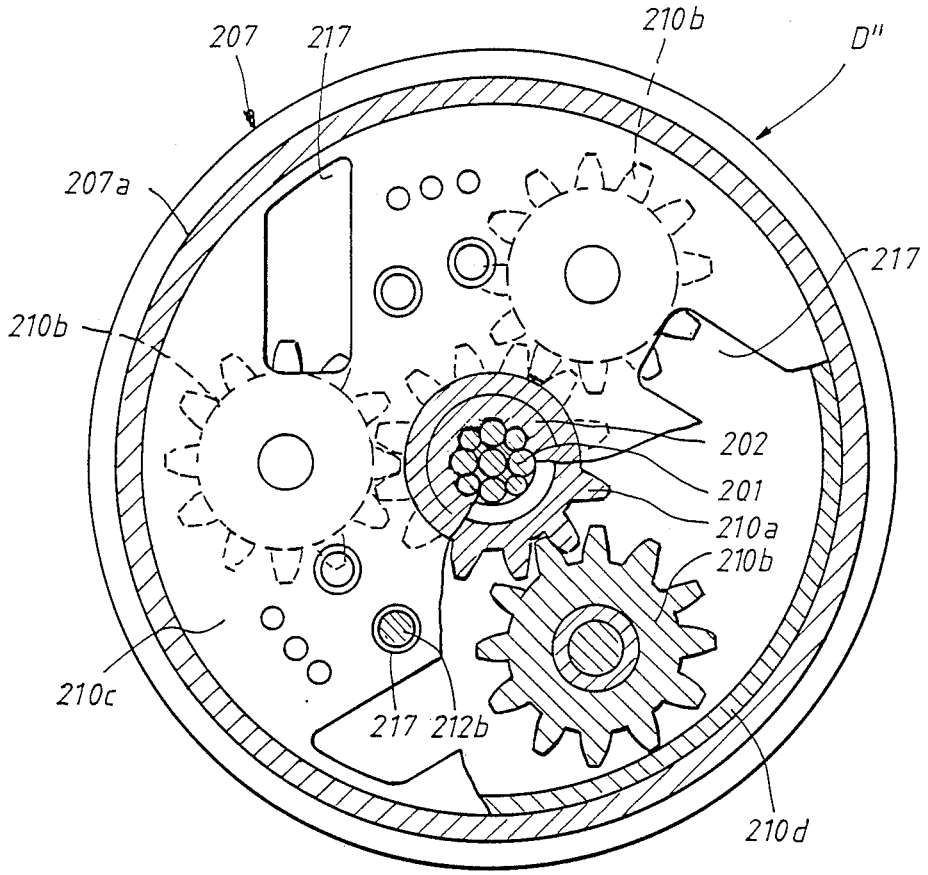
FIG. 6 is a transverse cross-sectional view of the lowering device of FIG. 5.
Figure 7:
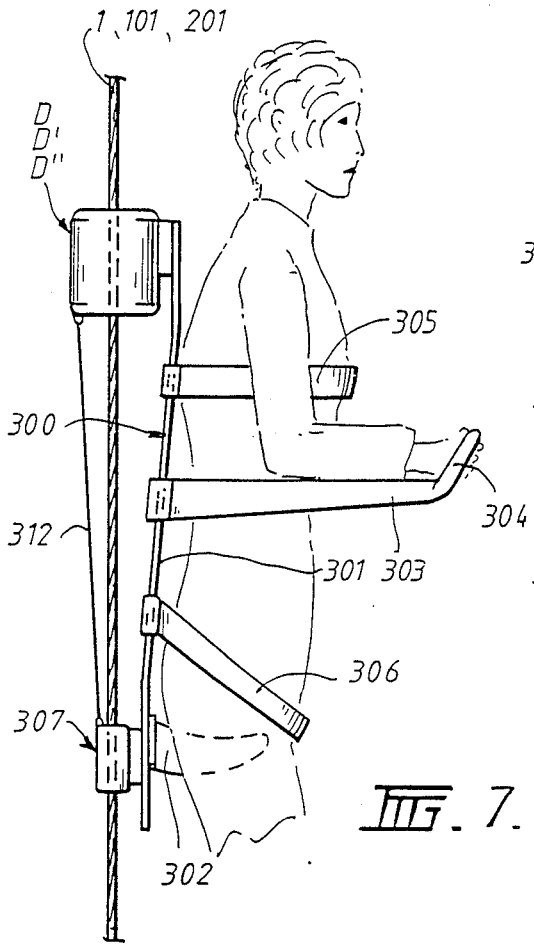
FIG. 7 is a side elevational view of a lowering device in accordance with any of the embodiments of FIGS. 1 to 6 in association with the support means for a person.

With reference to FIGS. 5 and 6 of the drawings the lowering devices D'' of the third embodiment of the invention utilizes a hydraulic system with a closed circuit gear pump containing a variable constricted orifice to apply a braking force within the lowering device as an alternative to the centrifugal braking systems utilized in the preceding embodiments.

The third embodiment therefore comprises once again, an inner rotatable tubular member 202 surrounding a cable 201 down which the lowering device is to travel. As with the previous embodiments the cable 201 is formed from a plurality of spirally wound or twisted cable strands of the type referred to in connection with the preceding embodiments.

The sleeve 202 is surrounded by a main housing 207 comprising an outer wall 207*a* of inverted cup-shaped configuration and through the centre of which the sleeve and cable combination 202, 201 passes with a series of 0-ring seals 209 interposed between the sleeve and the surrounding part of the outer wall 207*a*. In addition, a thrust bearing 303 is received and retained between an undercut 203*a* in the outer wall 207*a* and a ledge 203*b* around the sleeve 202. The inside of the wall 207*a* is provided with a circumferentially extending step against which a gear pump assembly, generally indicates as 210, is located. The lower end of the cup-shaped wall 207*a* is closed by a dished end wall 207*b* attached thereto by bolts 204. The dished end wall 207*b* has an internal diameter less than the internal diameter of the cup-shaped wall 207*a* whereby to engage the lower periphery of the gear pump assembly 210 to clamp it in position within the main housing 207. The sleeve and cable combination 202 and 201 passes through the centre of the end wall 207*b* and a ball bearing 211 is received and retained between a circumferential recess 211*a* on the inside of the end wall and a ledge 211*b* formed around the sleeve 202. O-ring seals 109 are also interposed between the end wall 207*b* and the sleeve 202 therethrough. A sub-housing 215 is supported on the outer wall 207*a* and attached thereto by bolts 204*a* and defines a chamber 215*a* for part of a speed control mechanism 212 to be later described.

The gear pump assembly 210 comprises a central sun gear 210*a* fixed to rotate with the sleeve 202, and in driving engagement with three equally spaced apart planet gears 210*b* which, in turn, are mounted on pinions retained at either side of the planet gears in a pair of mounting plates 210*c* and 210*d* between which the gear train is sandwiched. A series of orifices 217 are provided through at least the upper mounting plate 210*c* which allow for hydraulic fluid to be pumped by the gear pump and around within the housing 207.

The lowering device, as with the previous embodiments, has a connecting lug 220 formed on the outside surface of the outer wall 207*a*, with a T-shaped slot or keyway 220*a* being provided for engagement by a latching member forming part of a support frame to be later described.

In use, with a person suspended via the support frame on the lowering device, the device moves down the cable 201 by virtue of the inner sleeve 202 following the spiral or twisted cable strands and such is to in effect cause the sleeve to rotate about the cable as it moves down the cable, and the sun gear rotates therewith and the planet gears which are fixed with respect to the outer housing 207 via the mounting plate 210*c* and 210*d*. The gear train therefore acts as a gear pump pumping hydraulic fluid through a closed circuit, the path of which includes the spaces between the planet gears, the orifices 217 and at least the chamber 217*a* formed between the upper mounting plate 210*c* and the upper end wall of the outer wall 207*a*.

The gear pump in itself, having to pump fluid through a closed circuit within the housing, offers some resistance to rotation of the sun gear and the attached sleeve, and therefore controls to some degree the rate of descent of the lowering device down the cable. However, in order to achieve control over the speed of the descent, the speed control mechanism 212 referred to previously is provided, which consists of a valve stem 212*a*, having a valve member 212*b* at its lower end co-operating with a valve seat 212*c* within one of the orifices 217 through the mounting plate 210*c*. An upper portion of the valve stem 212*a* is threadably received 207*a* and carries at its upper end, within the chamber 215*a* defined by the sub-housing 215, a control gear 212*e* which in turn, meshes with the drive gear 212*f* carried by a shaft 212*g* which extends out through the wall of the sub-housing 215 to an outer support lug 212*h*. The section of the shaft 212*g* between the sub-housing and the support lug 212*h* carries a handle 212*i*, and such that, when pivoted by hand by the person suspended from the lowering device as it moves down the cable, the gear train, comprising gears 212*f* and 212*e*, raises and lowers the valve stem 212*a* and valve member 212*b* relative to the valve seat 212*c* whereby to increase or decrease the size of the gap between the valve member 212*b* and the valve seat 212*c*. By progressively decreasing the gap the resistance to fluid flow through the orifices is increased and the reaction of the gear pump is to slow down, thus slowing the speed of rotation of the inner sleeve 202 about the cable 201 and such as to decrease the rate of descent of the lowering device down the cable. By reversing the operation of the control mechanism to lift the valve member 212*b* away from the seat 212*c*, the size of the gap is increased, the resistance to fluid flow through the orifice is reduced, and the gear pump increases speed accordingly and thus the speed of descent down the cable also increases.

Turning to FIGS. 7 to 10 of the drawings, the lowering devices D, D′ or D″ in accordance with one or other of the preceding embodiments is associated with a support frame 300 for suspending a person from the device as it moves down the cable 1, 101 or 201. The support frame comprises an elongate support bar 301, the upper end of which carries a T-shaped latching member matching the T-shaped keyway 20*a*, 120*a* or 220*a* of the respective lowering device D, D′ or D″. The lower end of the support bar carries a seat 302 to engage beneath the buttocks of the occupant using the descent system, whilst approximately midway along the length of the bar a sub-frame 303 provides a pair of handles 304, one on either side of the occupant, and which are to be grasped by the occupant as shown. The support frame 300 is completed by a pair of straps 305 and 306 which are received to be fastened about the upper torso and the hip area respectively of the occupant.

Figure 9:
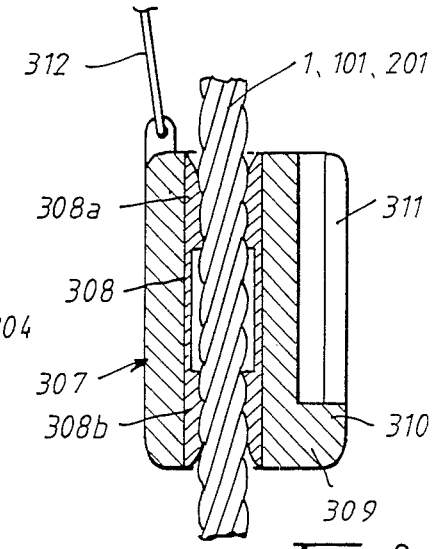
FIG. 9 is a vertical sectional view of a lower guide sleeve or runner forming part of the support means of FIGS. 7 and 8.
Figure 8:
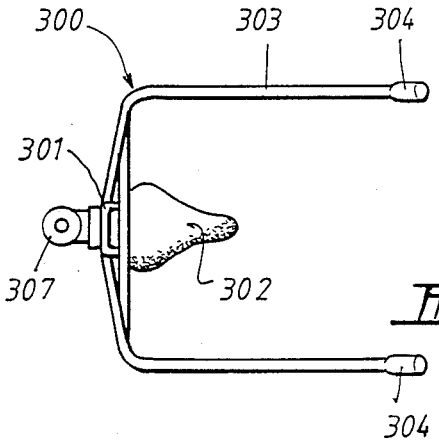
FIG. 8 is a plan view of the support means of FIG. 7, without an occupant.
Figure 10:
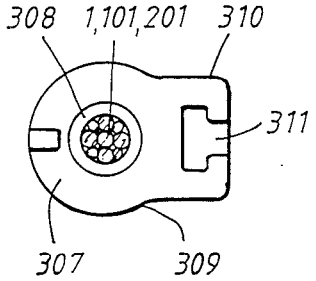
FIG. 10 is a plan view of the lower guide sleeve or runner of FIG. 9.

The coupling of the support frame 300 to the cable, apart from via the lowering devices, also includes guide sleeve or runner 307 (see FIGS. 9 and 10). The guide runner 307 comprises an inner rotatable sleeve 308 internally profiled at upper and lower end portions 308*a* and 308*b* to match and engage the spiral or twisted profile of the cable, whereby, when the runner 307 is down the cable, the inner sleeve 308 will rotate about the cable as it follows the spiral or twisted path of the cable strands. The runner is completed by an outer housing 309 surrounding the inner sleeve which rotates within the outer housing. The outer housing carries a connecting lug 310 have a T-shaped slot or keyway 311 formed vertically downwardly therethrough from an opening at the top of the lug but terminating short of the lower end and in which a mating T-shaped latching member carried by the lower end of the support frame 300 is received. The runner 307 is coupled to the lowering device D, D′ or D″ by a flexible tether 312 to keep the lowering device and the runner together as a combination.

Alternatively the support frame 300 may be replaced by a capsule coupled to the lowering device and in which the person is seated and enclosed, and which will afford protection if flames or other injurious or hazardous conditions exist in the path of descent.

Figure 11:
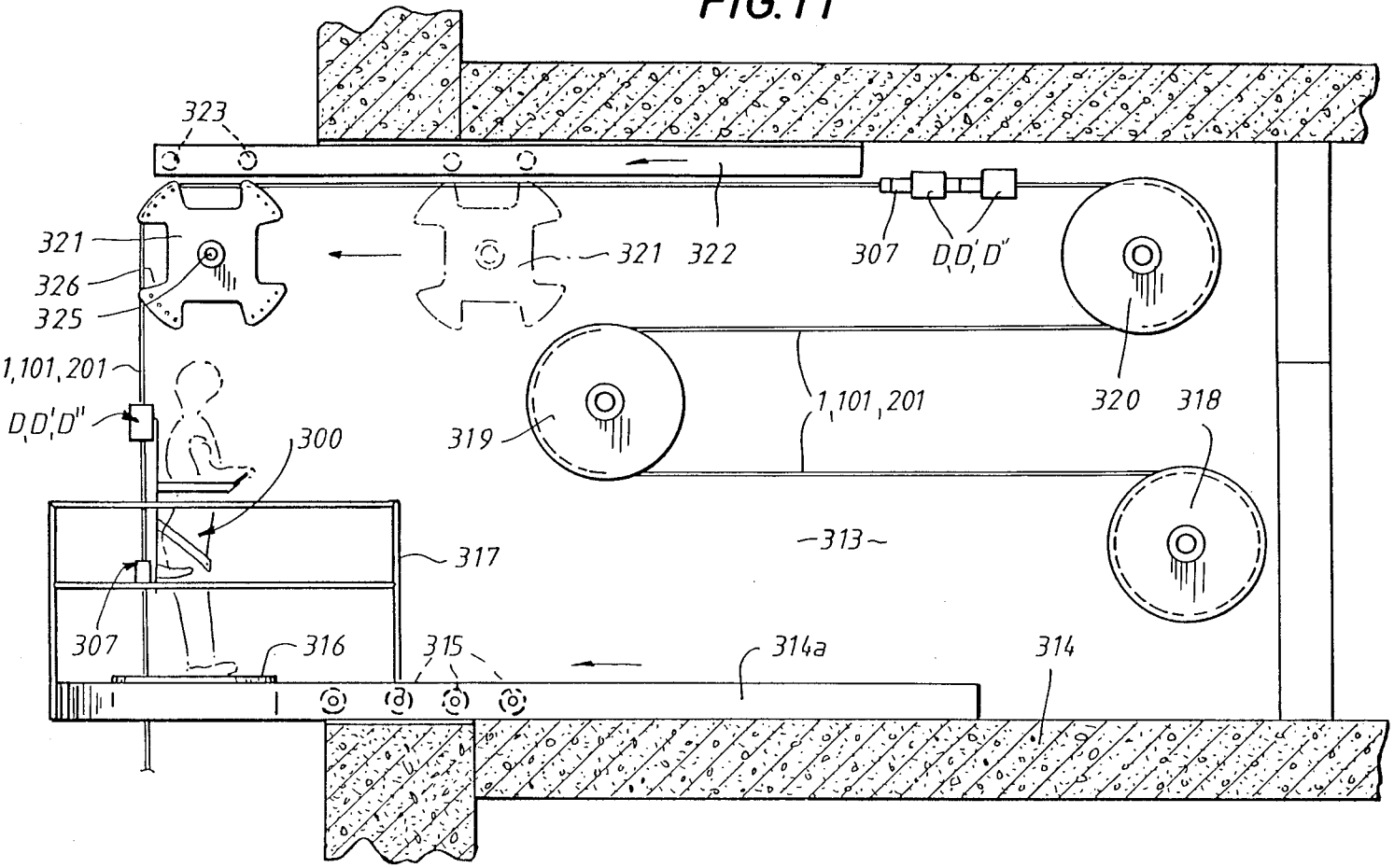
FIG. 11 is a side elevational view of a storage room within a high rise building incorporating the pulley system for the cable or rope down which persons are to descend, together with a loading station provided at the outer end of an extendable platform means.
Figure 12:
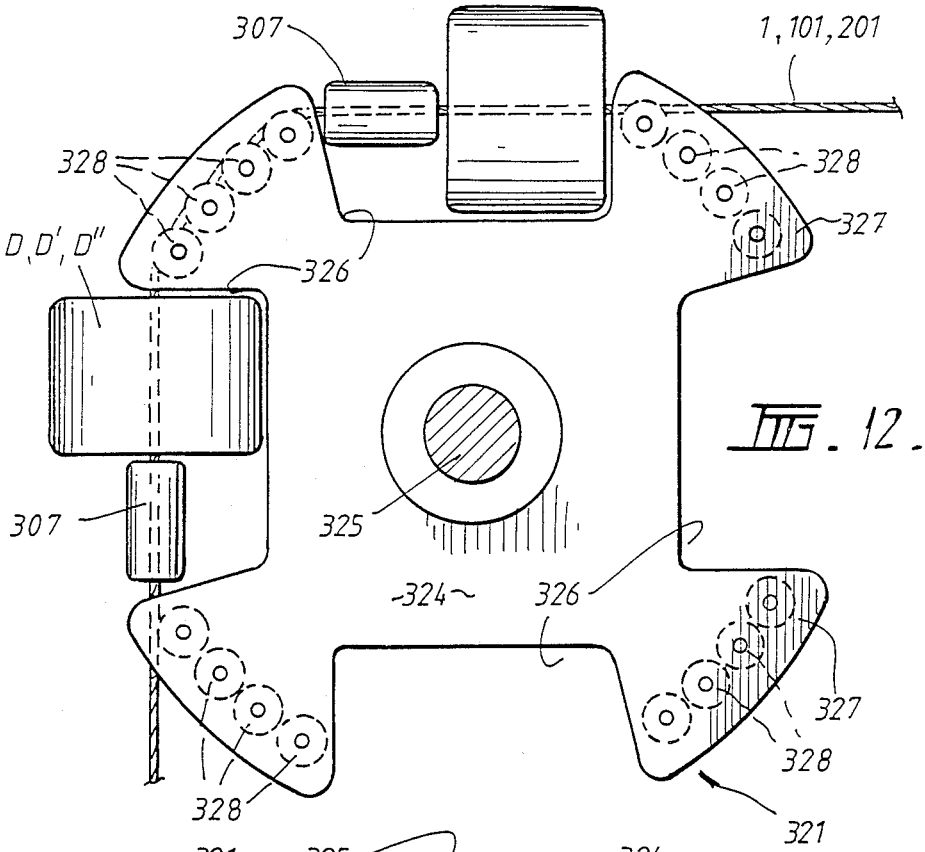
FIG. 12 is an end elevational view of a sheave forming part of the pulley system of FIG. 11 and for transferring lowering devices, in turn, along the cable or rope to the loading station.
Figure 13:
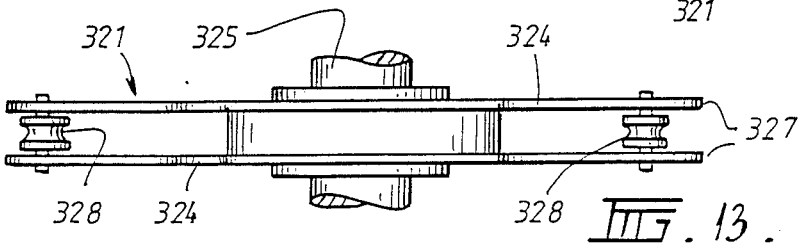
FIG. 13 is a side elevational view of the sheave of FIG. 12.

FIG. 11 of the drawings represents a schematic side elevational representation of a storage room 313 within a high rise building for storing the descent system, comprising the cable 1, 101 or 2012, a plurality of lowering devices D, D′ or D″, each in combination with a runner 307, together with support frames 300 to complete the system.

Figure 14:
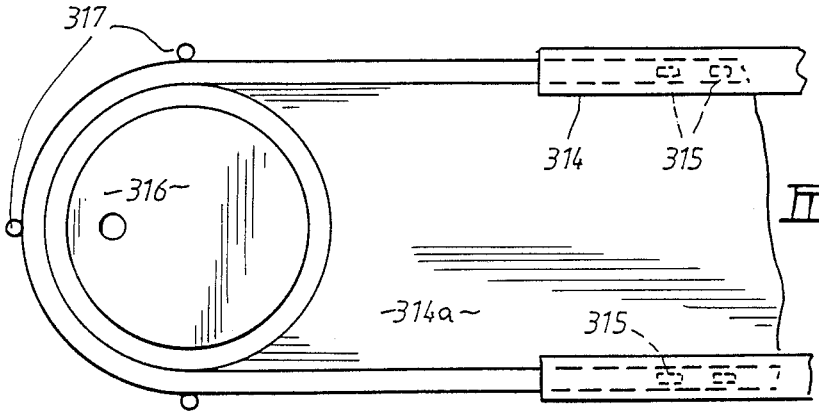
FIG. 14 is a plan view of the extendable platform forming part of the system of FIG. 11.

The cable and a plurality of lowering device/runner combinations are stored on a pulley and sheave system within the storage room 313, which room is suitably fire rated, and which has access to the outside of the building via a removable wall panel (not shown) when the system is required to be used. The floor 314 of the storage room 313 carries a platform 314*a* mounted on rollers 315 engaging appropriate rails whereby it can be extended to a position with its outer end extending beyond the side of the building. The platform incorporates a trap door 316 which, when a person has been strapped into the support frame 300 and the frame is attached to a lowering device/runner combination, the trap door will then be swung downwardly open to allow the person to drop through the platform and descent down the cable (see also FIG. 14). The outer end of the platform may also carry a hand rail 317. The pulley and sheave system within the storage room comprises a main drum 318 for the cable and from which it will be unwound when required. The cable extends around a pair of intermediate sheaves 319 and 320 to a transfer sheave 321 also mounted on a frame 322 carrying rollers 323 engaging rails to allow the transfer sheave to be extended out beyond the wall of the building to a position above the extended platform.

The transfer sheave 321 provides for the transfer of lowering device/runner combinations along the cable from a storage position on the cable between the transfer sheave 321 and the preceding intermediate sheave 320. The transfer sheave 321 comprises a pair of parallel spaced apart side plates 324 carried by a freely rotatable axle 325, and shaped at four positions at 90° C. to each other to provide recesses 326 within which a lowering device/runner combination will be received as they are advanced along the cable when the sheave is rotated. The radially protruding sections 327 of the side plates 324 progressively engage the combinations as the sheave rotates to transfer them, in turn, along the cable 1 at a time to the platform. The cable is, in turn, trained around a plurality of guide rollers 328 the axes of which lie on the arc of a circle, and each guide roller extends between the protruding sections 327 of the side plates 324.

Figure 15:
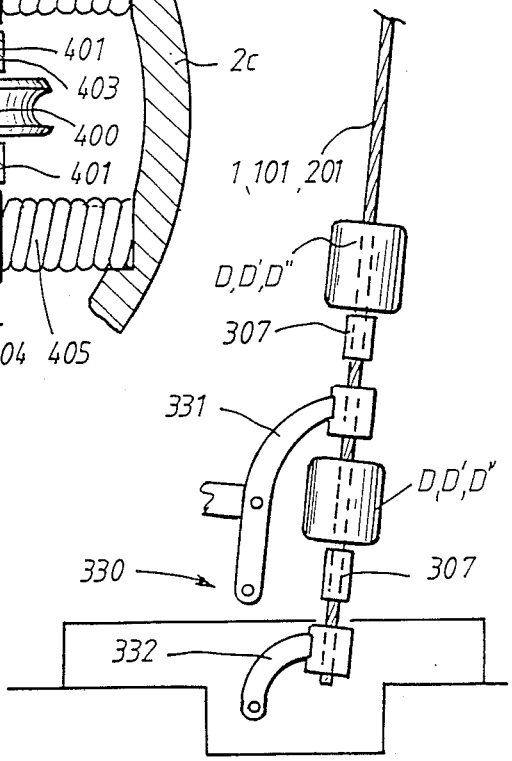
FIG. 15 is a side elevational view of an anchor device for anchoring the lower end of the cable or rope at ground level.

When the descent system is in use, cable is unwound from the main storage drum 318 over the sheaves and its free end lowered to ground level, where, with reference to FIG. 15 of the drawings, it is connected to an anchoring device 330 provided at footpath or road level. It is envisaged that, if the positioning of the anchoring device 330 relative to the side of the building is such that the cable, when anchored, will adopt an inclination of in the order of 5° to the vertical, the weight of the person suspended from the lowering device will be sufficient to hold the outer housing of the lowering device stationary such as to not rotate with the rotating inner sleeves 2, 102, 202, and thus the person descending will not rotate about the cable. The anchoring device 330 comprises a pair of clamps, namely, an upper clamp 331 and a lower clamp 332, both of which are mounted to pivot toward and away from the end of the cable. As persons descend and reach ground level they are released from the lowering device/runner combinations, and a number of such combinations will accumulate at the end of the cable. The accumulated combinations can be removed by releasing the upper clamp 321 from the cable to allow a combination to drop to the lower clamp 322, whereafter, if the upper clamp 321 is reclamped to the cable, the lower clamp can then be released, and the combination taken off the end of the cable. The process is repeated periodically, or continuously, to remove the combinations as they accumulate at the lower end of the cable.

Figure 16:
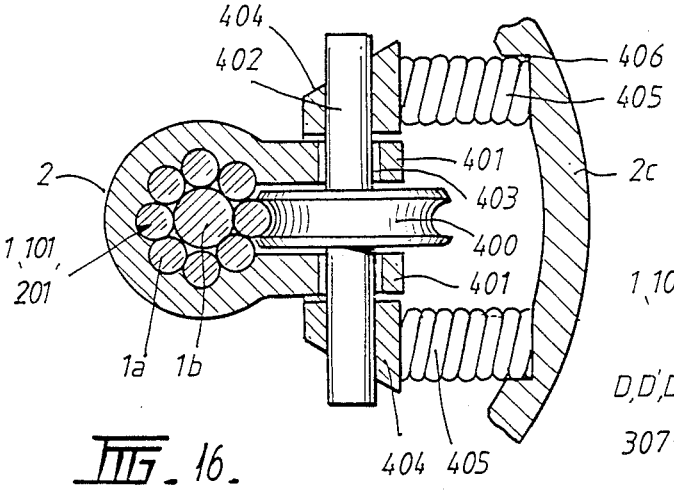
FIG. 16 is a part plan view of a lowering device incorporating an alternative cable or rope engaging system.

Part of FIG. 16 of the drawing shows a cable configuration of the type referred to previously, that is, the cable 1, 101 or 201 is formed from a plurality of spirally wound or twisted cable strands 1*a* extending down and around a central core strand 1*b*. More recent development work on a suitable cable construction has resulted in one formed from four major strands twisted together, with each major strand being from 19 twisted substrands.

Figure 17:
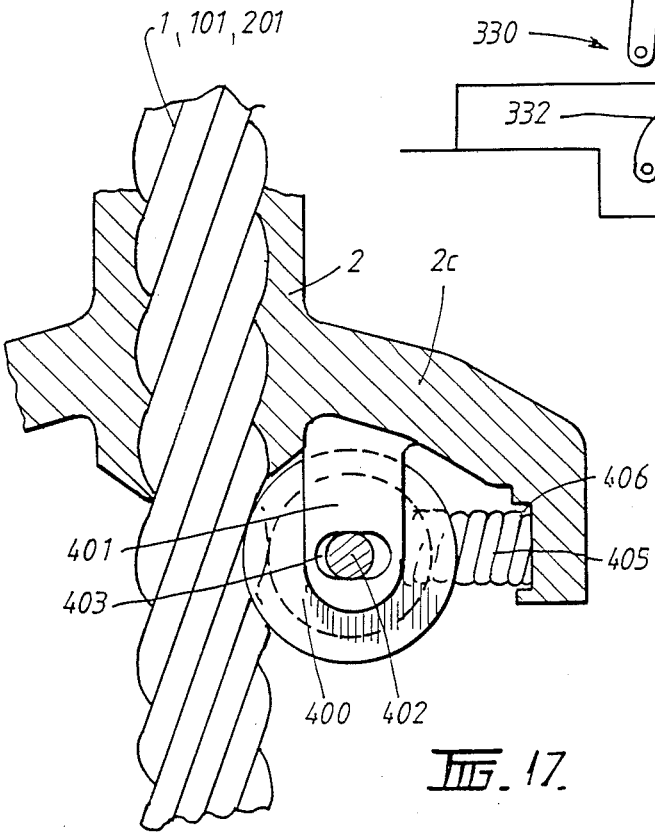
FIG. 17 is a sectional side elevation view of the alternative of FIG. 16.

FIG. 17, and the remainder of FIG. 16, of the drawings illustrate an alternative manner of engagement between the lowering device of FIGS. 1 and 2 with the cable 1 to follow the spiral or twisted path of the cable strands 1*a*, and which comprises a guide wheel 400 supported between a pair of lugs 401 on an axle 402. The axle 402 passes through elongate holes 403 in the lugs, and the free ends of the axle 402 beyond the sides of the lugs 401, carry members 404 which are engaged by compression springs 405 which bias the wheel 400 against the cable with its circumferential profile matching and engaging the profile of a relevant cable strand 1*a*. The other ends of the springs are located in recesses 406 formed on the inside of the bell-shaped housing 2*c* which is formed as part of the inner rotatable sleeve 2 in the embodiment of FIGS. 1 and 2, and the lugs 401 are, in turn, also fixed to the housing 2*c*. Three such guide wheel arrangements may be provided around the sleeve at equally spaced positions, with the centrifugal braking mechanisms as described with reference to FIGS. 1 and 2 being provided between adjacent guide wheel arrangements.

Figure 18:
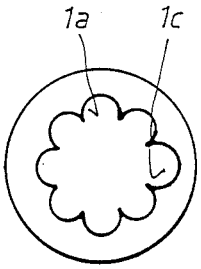
FIG. 18 is a cross-sectional view through an alternative specially formed cable or rope for use with the lowering devices of the present invention and to form part of the descent system of the present invention.

Finally, with reference to FIG. 18 of the drawings, as an alternative to the cable configuration illustration as part of FIG. 16, a special cable configuration may be manufactured in which one or more of the spirally wound or twisted cable strands 1*c* may be of a significantly larger diameter than the other strands, and the inner rotatable sleeves of the lowering devices D, D′ or D″ and/or the guide wheel or wheels of FIGS. 16 and 17, configured to engage the particularly enlarged stand or strands.

We claim:

1. A lowering device adapted, in use, to engage a cable or rope of a twisted configuration, and comprising an inner rotatable means surrounding and engaging said cable or rope to follow the twist therein and thereby rotate about the cable or rope as it descends down said cable or rope, said rotatable means being supported by, and rotatable within, an outer housing having means to support a load therefrom, and means for controlling the speed of rotation of said rotatable means and therefore the rate of descent of said lowering device down said cable or rope.

2. A device as claimed in claim 1, wherein the means of controlling the speed of rotation of the inner rotatable means is a closed circuit gear pump driven by the inner means and forming part of a hydraulic circuit containing a constriction to control the speed of the pump and therefor the speed of rotation of the inner means and therefor the speed of descent.

3. A device as claimed in claim 2, wherein the constriction is an orifice and an associated valve member is operable to vary the degree of constriction at the orifice.

4. A device as claimed in claim 1, wherein the means for controlling the speed of rotation of the inner rotatable means is a centrifugal brake rotating with the inner means and engaging the outer housing with a force which increases and decreases with increasing and decreasing speed of rotation to maintain a relatively constant speed of rotation and therefore speed of descent.

5. A device as claimed in any one of claims 1 to 4, wherein said means to support a load from said device is such as to support a person.

6. A device as claimed in claim 5, wherein said means to support a person is a support bar detachably connected to the outer housing and to which the person is strapped.

7. A device as claimed in claim 6, wherein said support bar is attached at its upper end to said housing and its lower end to a guide sleeve adapted to surround said cable or rope, and carries means at its lower end to engage beneath the buttocks of the person, together with handle means extending away from said support bar approximately mid-way along its length and to be grasped by the person, with strap means also carried by said support bar to be received and fastened about the body of the person.

8. A device as claimed in any one of claims 1 to 7, in combination with a cable or rope adapted to extend from an elevated location to an anchor point at ground level to form a descent system.

9. A descent system as claimed in claim 8, wherein said cable or rope is stored on a pulley system located at the elevated location from which it is unwound and lowered to ground level for attachment to an anchor point, and said pulley system incorporates means to progressively transfer a plurality of said lowering devices, in turn, along said cable or rope to a loading station at which said support means, and associated persons, are, in turn, coupled to said lowering devices to descend down said cable or rope.

10. A descent system as claimed in claim 9, wherein said loading station is situated at the end of a platform means adapted to extend beyond said elevated location.

* * * * *